US012012705B2

(12) United States Patent
Park

(10) Patent No.: US 12,012,705 B2
(45) Date of Patent: Jun. 18, 2024

(54) AIR BARRIER SYSTEM II FOR BLOCKING INFLOW OF FOG

(71) Applicant: Sea Man Park, Seoul (KR)

(72) Inventor: Sea Man Park, Seoul (KR)

( * ) Notice: Subject to any disclaimer, the term of this patent is extended or adjusted under 35 U.S.C. 154(b) by 1021 days.

(21) Appl. No.: 16/769,571

(22) PCT Filed: Dec. 4, 2017

(86) PCT No.: PCT/KR2017/014047
§ 371 (c)(1),
(2) Date: Jun. 3, 2020

(87) PCT Pub. No.: WO2019/112069
PCT Pub. Date: Jun. 13, 2019

(65) Prior Publication Data

US 2020/0340197 A1 Oct. 29, 2020

(51) Int. Cl.
*E01H 13/00* (2006.01)
*F24F 9/00* (2006.01)

(52) U.S. Cl.
CPC ..... *E01H 13/00* (2013.01); *F24F 9/00* (2013.01); *F24F 2009/007* (2013.01)

(58) Field of Classification Search
CPC ..... E01F 7/025; F24F 2009/007; F24F 9/00; E01H 13/00; E03B 3/28
See application file for complete search history.

(56) References Cited

FOREIGN PATENT DOCUMENTS

| | | | | | |
|---|---|---|---|---|---|
| CN | 206477300 | U | | 9/2017 | |
| JP | 2001-295237 | A | | 10/2001 | |
| JP | 2001295237 | | * | 10/2001 | ..... E01H 13/00 |
| KR | 10-1004779 | B1 | | 1/2011 | |
| KR | 10-2012-0030178 | A | | 3/2012 | |
| KR | 10-1204359 | B1 | | 11/2012 | |
| KR | 10-1615225 | B1 | | 4/2016 | |
| KR | 101615225 | | * | 4/2016 | ..... E01F 7/02 |

* cited by examiner

*Primary Examiner* — Christopher R Dandridge
(74) *Attorney, Agent, or Firm* — Han's Law Office

(57) ABSTRACT

The present disclosure relates to an air barrier system II for blocking inflow of fog. According to the present disclosure, provided is an air barrier system which does not affect wind load while effectively preventing fog from flowing toward a road.

10 Claims, 8 Drawing Sheets

[FIG. 1]
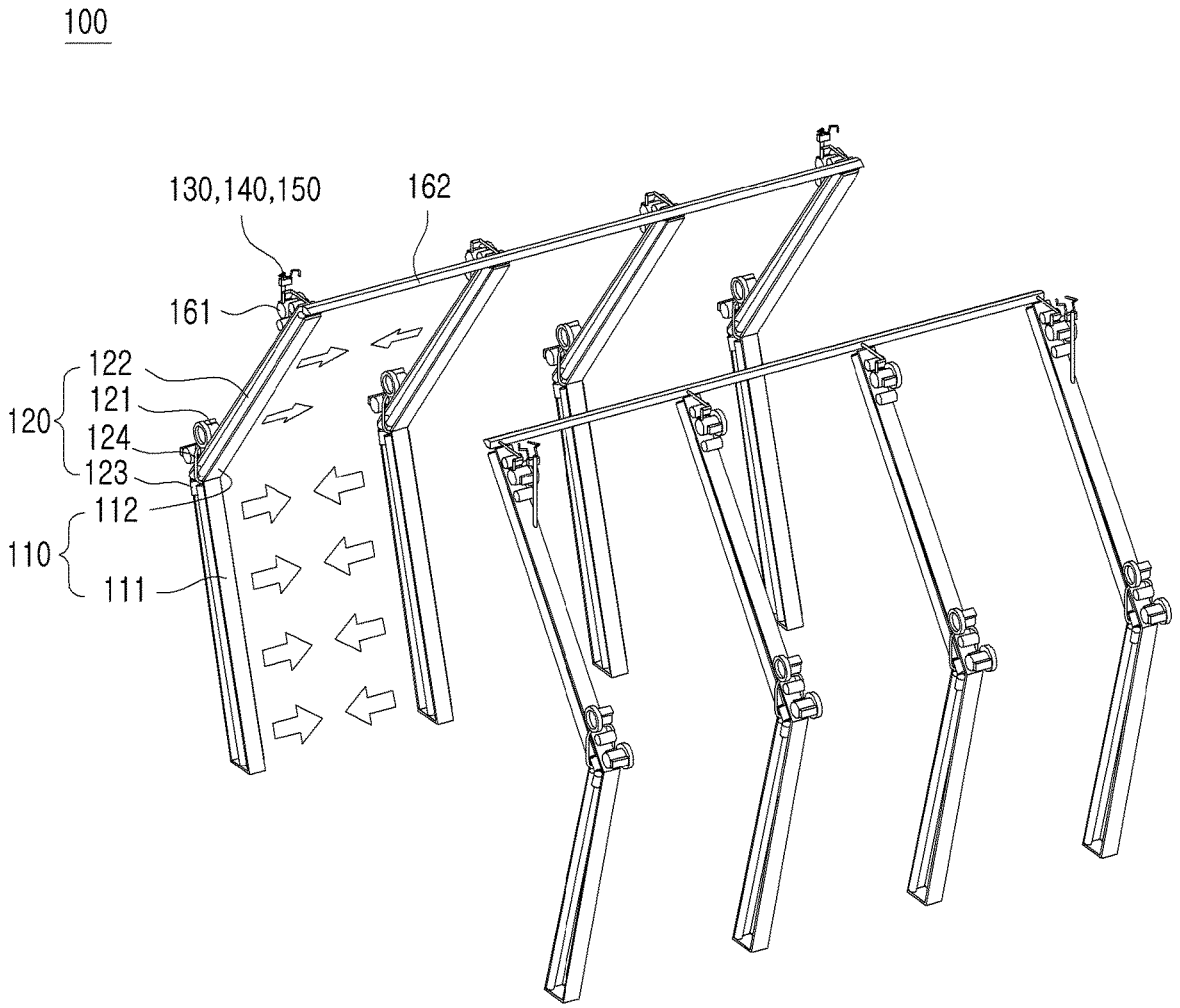

[FIG. 2]
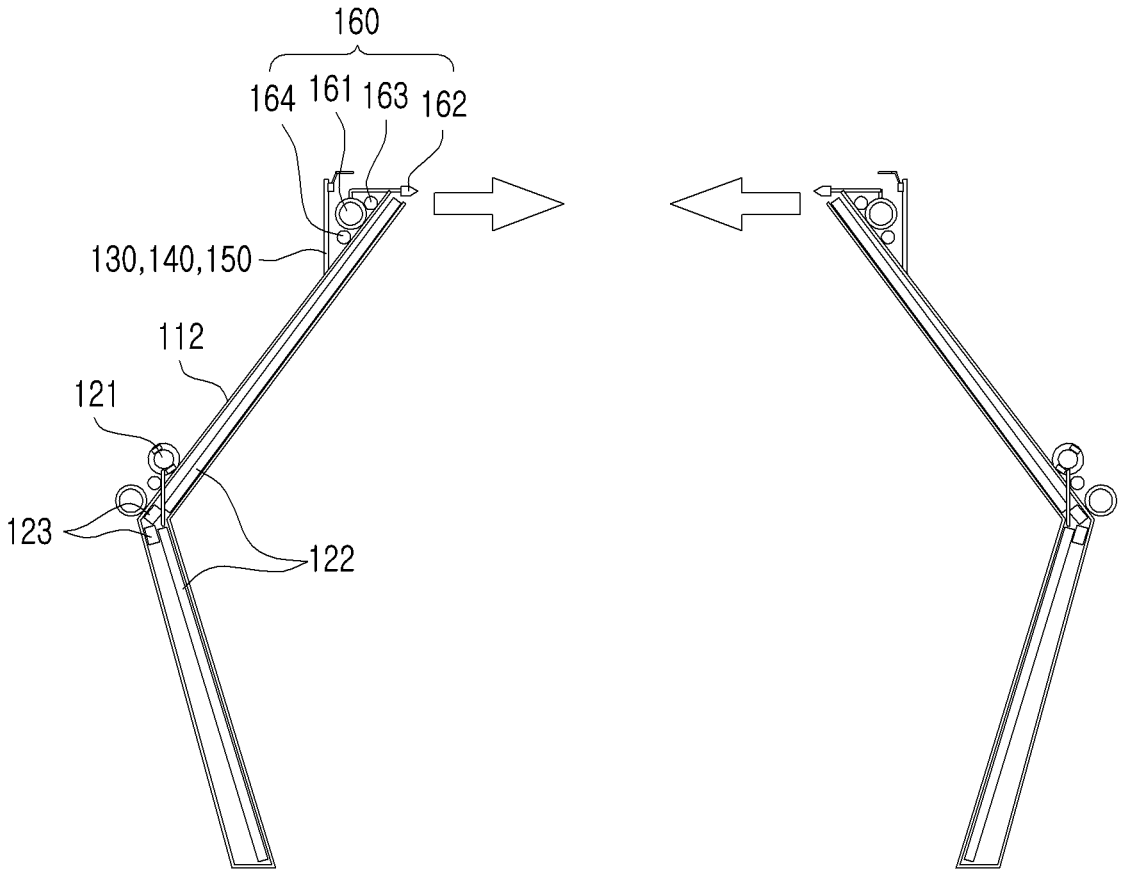

[FIG. 3]
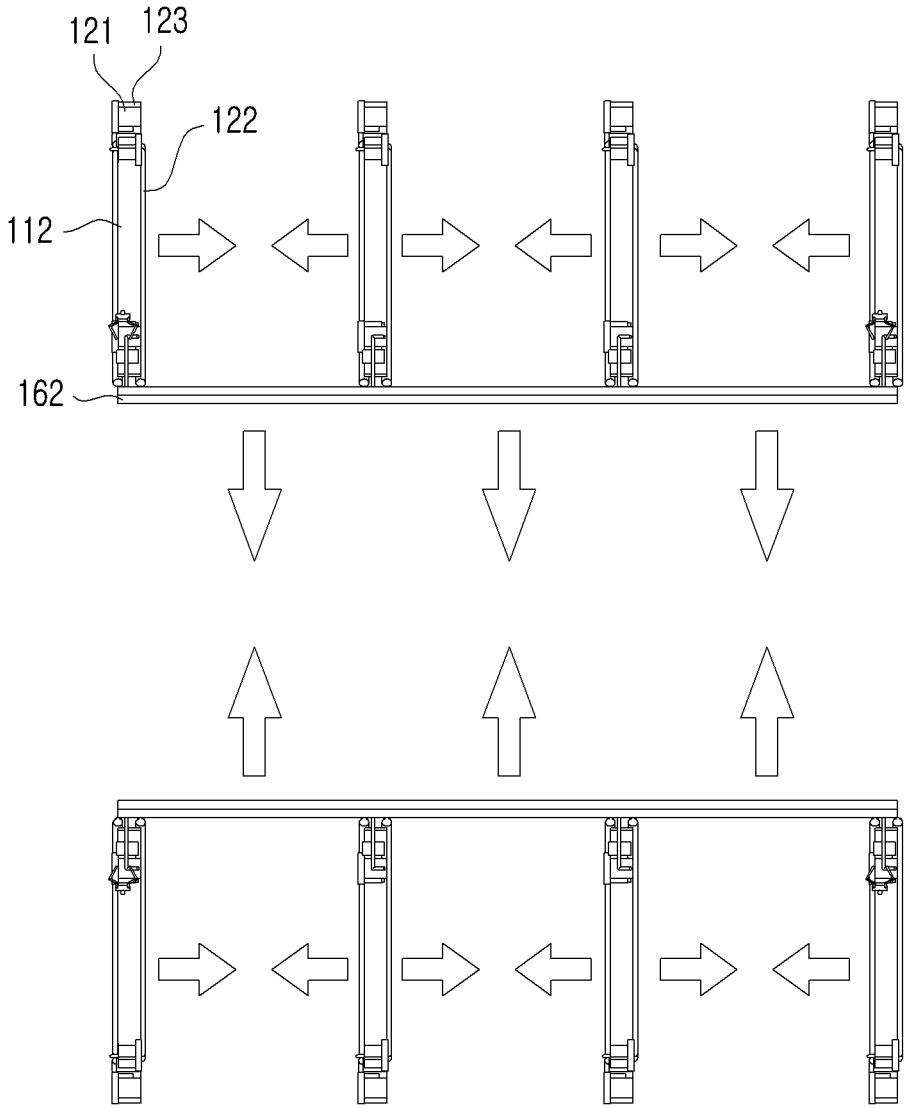

[FIG. 4]
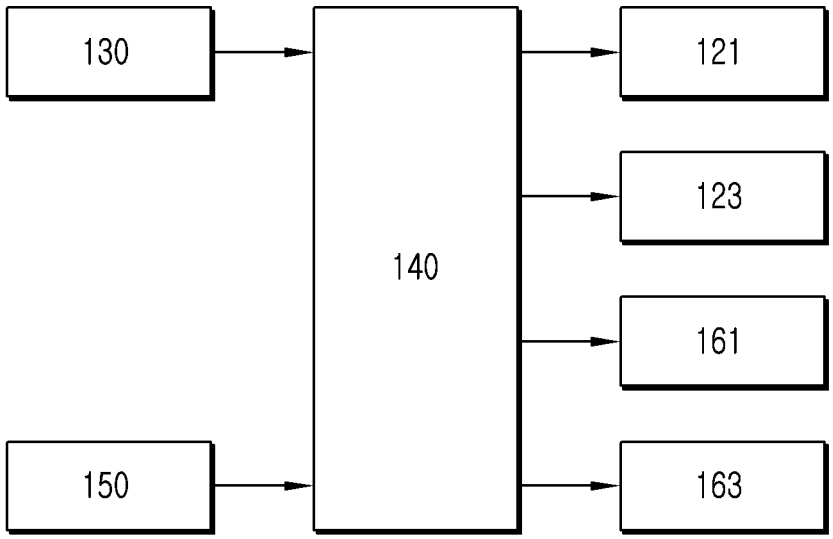

[FIG. 5]
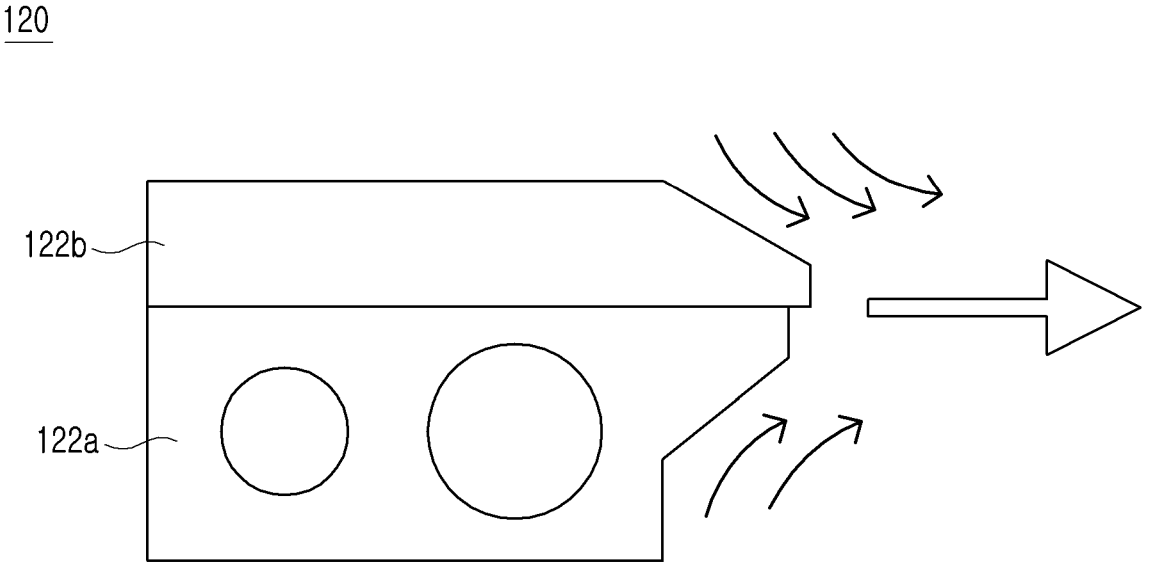

[FIG. 6]
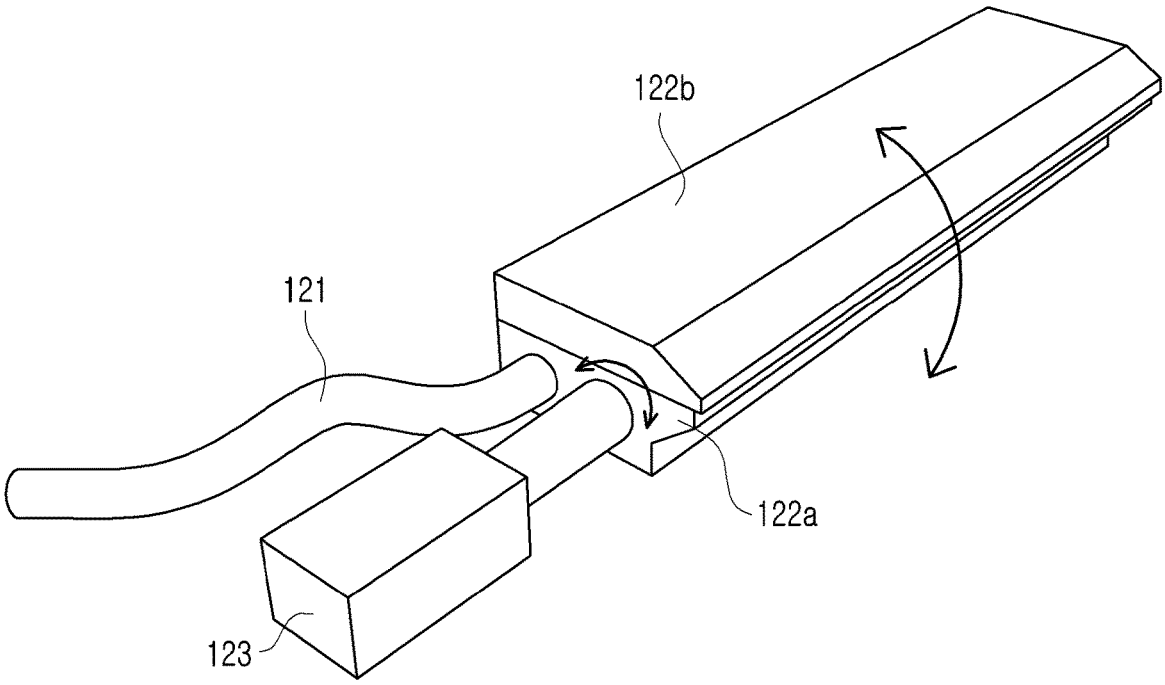

[FIG. 7]
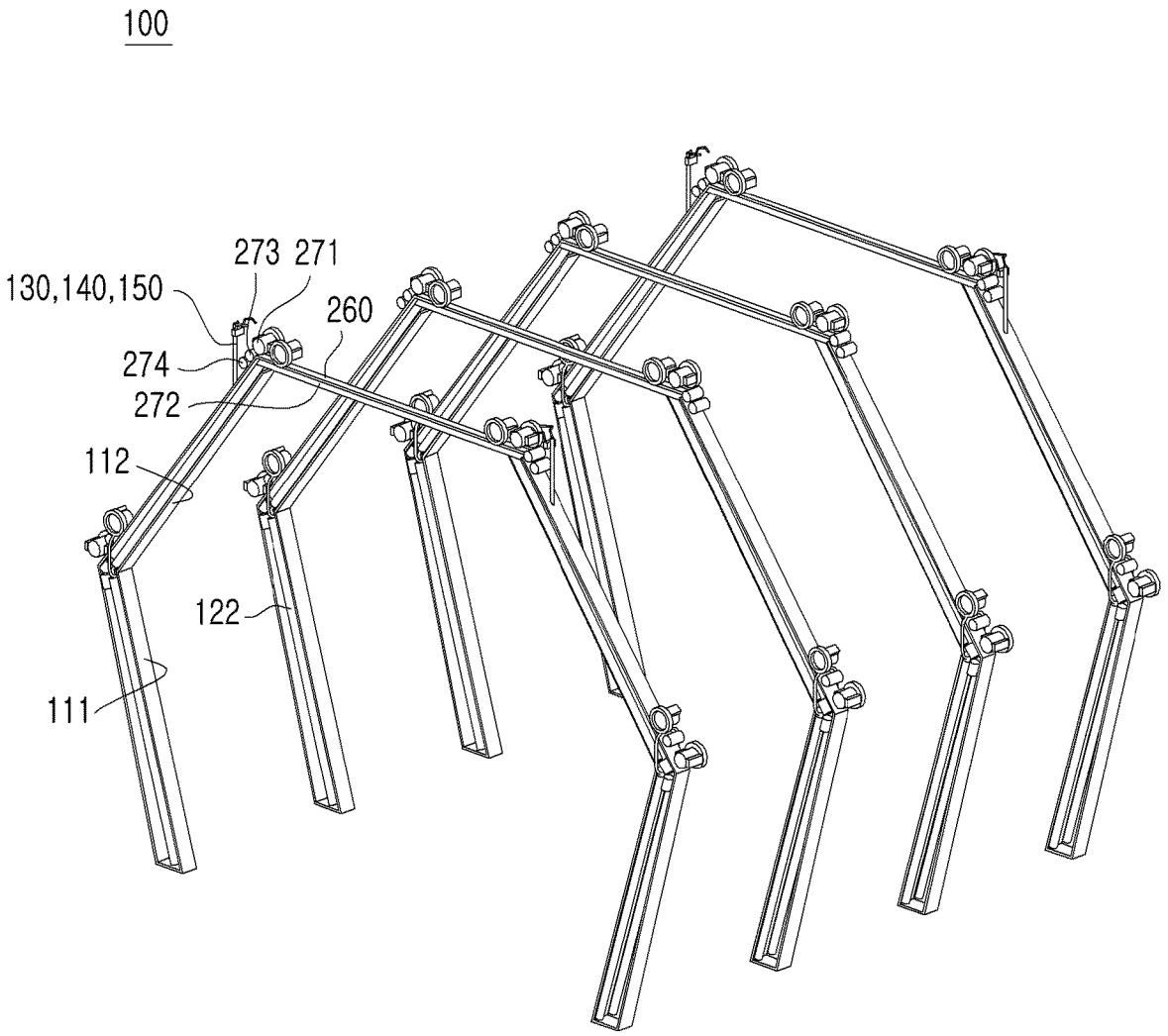

[FIG. 8]
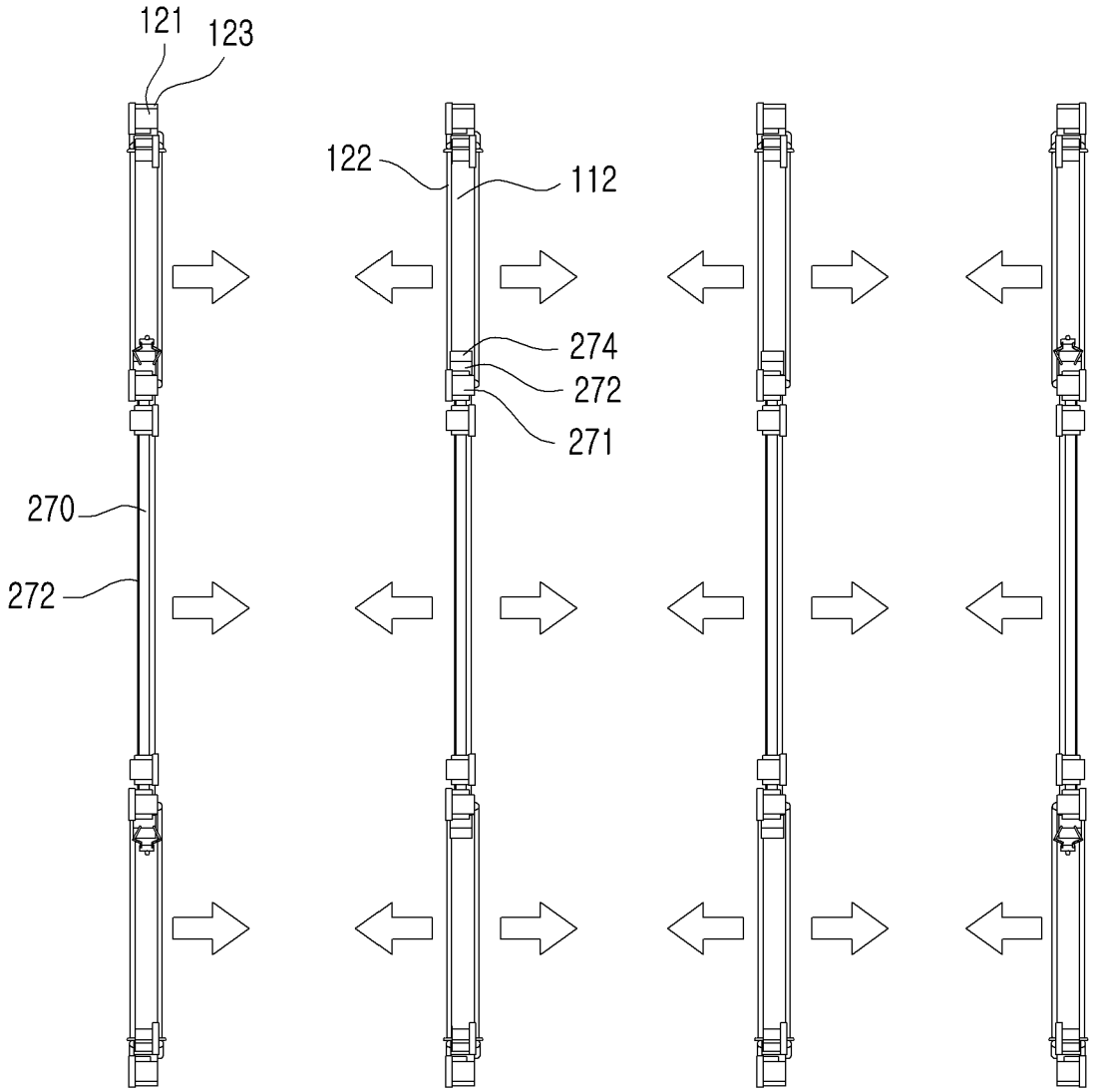

AIR BARRIER SYSTEM II FOR BLOCKING INFLOW OF FOG

1. FIELD

The present disclosure relates to an air barrier system II for blocking inflow of fog, and more particularly, to an air barrier system II for blocking inflow of fog, that forms an air barrier between a plurality of first frame units installed along an edge of a road, and therefore, does not affect wind load while effectively blocking inflow of fog to the road.

2. BACKGROUND

Fog refers to a phenomenon in which small water droplets float near the surface as water vapor in the atmosphere condenses. When such fog occurs on roads and bridges, the visibility distance of a driver is reduced to less than 1 km, and thus, there is a high possibility of a traffic accident.

Korean Registered Patent Publication no. 10-1004779 discloses a 'fog blocking device' that may be installed on a road.

Korean Registered Patent Publication no. 10-1004779 n discloses a fog removal device that includes a fog blocking board installed to extend upwardly from the surface near a road in order to block the fog occurring on the road, and a fog removal unit installed between the fog blocking board and the road, to discharge dry air to the road, thereby removing the fog.

However, according to Korean Registered Patent Publication no. 10-1004779, there is a problem that the fog blocking board keeps vehicle drivers from viewing the scenery around the road, and that due to the wind load caused by the fog blocking board and the weight of the establishment, the device cannot be installed on a bridge.

SUMMARY

A purpose of the present disclosure is to resolve the aforementioned problems of prior art, that is, to provide an air barrier system II for blocking inflow of fog, that forms an air barrier between a plurality of first frame units being installed along an edge of a road, and therefore, does not affect wind load while effectively blocking inflow of fog to the road.

The aforementioned purpose can be achieved by the air barrier system II for blocking inflow of fog, that includes a first frame unit that is provided in plural and are installed along an edge of a road; and a first injection unit that is installed on the first frame unit and that injects air to the first frame unit side that the first injection unit faces, to form a first air barrier for blocking inflow of fog to the road.

Further, the first injection unit may include a first air blast unit that is installed on the first frame unit and that inhales outside air, and a first air knife unit that is installed along a longitudinal direction of the first frame unit and that forms the first air barrier by receiving the outside air from the first air blast unit and injecting the received air.

Further, the present disclosure may further include a first detection unit that is installed on the first frame unit to detect the fog, and that generates a fog signal in response to detecting a preset value of fog or above; and a control unit that controls operations of the first air blast unit using the fog signal.

Further, the present disclosure may further include a second detection unit that is installed on the first frame unit and that detects a wind speed to generate wind speed information, and the first injection unit may further include a first rotation unit that rotates one end of the first air knife unit to adjust a direction of the air being injected from the first air knife unit, and the control unit may control operations of the first rotation unit using the wind speed information.

Further, the present disclosure may further include a third detection unit that is installed on the first frame unit, and that detects temperature to generate temperature information, and the first injection unit may further include a first heat unit that heats the air being supplied from the air blast unit to the first air knife unit so that the air to be injected from the air knife unit is injected at a preset temperature, and the control unit may control operations of the first heat unit using the temperature information.

Further, the present disclosure may further include a second injection unit that is respectively connected to an upper end of the plurality of first frame units, and that forms a second air barrier by injecting air to a width direction of the road.

Further, the second injection unit may include a second air blast unit that is installed on the first frame unit and that inhales outside air, and a second air knife unit that forms the second air barrier by receiving the outside air from the second air blast unit and injecting the received air.

Further, the control unit may control operations of the second air blast unit using the fog signal.

Further, the second injection unit may further include a second rotation unit that rotates one end of the second air knife unit to adjust a direction of the air being injected from the second air knife unit, and the control unit may control operations of the second rotation unit using the wind speed information.

Further, the second injection unit may further include a second heat unit that heats the air being supplied from the air blast unit to the second air knife unit so that the air to be injected from the second air knife unit is injected at a preset temperature, and the control unit may control operations of the second heat unit using the temperature information.

Further, the first frame unit may be provided in one pair and arranged to face each other with the road placed between the one pair of first frame units, and the present disclosure may further include a second frame unit that is provided in plural and are respectively connected to an upper end of the one pair of first frame units that face each other with the road placed between the one pair of first frame units; and a third injection unit that is installed along a longitudinal direction of the second frame unit, and that forms a third air barrier by injecting air to the second frame unit side that the third injection unit faces.

According to the present disclosure, provided is an air barrier system II for blocking inflow of fog, that does not affect wind load while effectively blocking inflow of fog to the road.

Further, according to the present disclosure, there is an effect of having a system for blocking inflow of fog installed without undermining the scenery around the road.

BRIEF DESCRIPTION OF THE DRAWINGS

FIG. 1 is an overall view of an air barrier system II for blocking inflow of fog according to a first embodiment of the present disclosure.

FIG. 1 is an overall view of an air barrier system II for blocking inflow of fog according to a first embodiment of the present disclosure.

FIG. 2 is a side view of the air barrier system II for blocking inflow of fog according to a first embodiment of the present disclosure.

FIG. 3 is a plane view of the air barrier system II for blocking inflow of fog according to a first embodiment of the present disclosure.

FIG. 4 illustrates an electrical connection between configurative elements of the air barrier system II for blocking inflow of fog according to a first embodiment of the present disclosure.

FIG. 5 is an enlarged view of a first air knife unit of the air barrier system II for blocking inflow of fog according to a first embodiment of the present disclosure.

FIG. 6 illustrates a rotation of the first air knife unit according to operations of a first rotation unit of the air barrier system II for blocking inflow of fog according to a first embodiment of the present disclosure.

FIG. 7 is an overall view of an air barrier system II for blocking inflow of fog according to a second embodiment of the present disclosure.

FIG. 8 is a plane view of the air barrier system II for blocking inflow of fog according to a second embodiment of the present disclosure.

DETAILED DESCRIPTION

Hereinbelow, the air barrier system II for blocking inflow of fog according to a first embodiment of the present disclosure will be described in detail with reference to the drawings attached.

FIG. 1 is an overall view of the air barrier system II for blocking inflow of fog according to a first embodiment of the present disclosure, FIG. 2 is a side view of the air barrier system II for blocking inflow of fog according to a first embodiment of the present disclosure, FIG. 3 is a plane view of the air barrier system II for blocking inflow of fog according to a first embodiment of the present disclosure, FIG. 4 illustrates an electrical connection between configurative elements of the air barrier system II for blocking inflow of fog according to a first embodiment of the present disclosure, FIG. 5 is an enlarged view of a first air knife unit of the air barrier system II for blocking inflow of fog according to a first embodiment of the present disclosure, and FIG. 6 illustrates a rotation of the first air knife unit according to operations of a first rotation unit of the air barrier system II for blocking inflow of fog according to a first embodiment of the present disclosure.

As illustrated in FIGS. 1 to 6, the air barrier system II for blocking inflow of fog according to a first embodiment of the present disclosure 100 includes a first frame unit 110, a first injection unit 120, a first detection unit 130, a control unit 140, a second detection unit 150, and a second injection unit 160.

The first frame unit 110 is provided in plural and are installed along an edge of a road, and the first injection unit 120, that will be described hereinbelow, is installed along a longitudinal direction of the first frame unit 110.

Such a first frame unit 110 may include a first pipe 111 and a second pipe 112. The first pipe 111 is installed from a ground of the edge of the road, and the second pipe 112 is installed from an upper end of the first pipe 111, but to have a slope towards the road. An upper end of a plurality of second pipes 112 may be connected by a second air knife unit 162 that will be described hereinbelow.

Meanwhile, the first frame unit 110 may be provided in one pair that face each other with the road placed between them.

By such a first frame unit 110, a space is secured in which an air barrier may be formed.

The first injection unit 120 is installed along the longitudinal direction of the first frame unit 110 described above, to inject air to the first frame unit 110 side that the first injection unit 120 faces, so that a first air barrier for blocking inflow of fog to the road, is formed.

Such a first injection unit 120 includes a first air blast unit 121, a first air knife unit 122, a first rotation unit 123, and a first heat unit 124.

The first air blast unit 121 inhales outside air and supplies the inhaled air to the first air knife unit 122 that will be described hereinbelow, and the first air blast unit 121 is installed on the first frame unit 110 described above.

Operations of such a first air blast unit 121 are controlled by the control unit 140 that will be described hereinbelow. The control unit 140 controls operations and stop of the first air blast unit 121 based on a fog signal generated in the first detection unit 130. By the first air blast unit being controlled by such a control unit 140, the first air barrier is formed only when fog is generated near the road, and therefore, efficiency of the system can be significantly improved.

Meanwhile, inside such a first air blast unit 121, a motor for absorbing and delivering the outside air, may be installed, and as this motor rotates, heat energy may be generated in the motor. By such heat energy, heat may be supplied to the gas being supplied to the first air knife unit 122, and by such heat included in the gas, the first air barrier may have heat. By such heat, the fog surrounding the first air barrier can be dissipated by heat, and therefore, efficiency of blocking inflow of fog can be significantly improved.

The first air knife unit 122 is installed along the longitudinal direction of the first frame unit 110, and the first air knife unit 122 forms the first air barrier by receiving the outside air from the first air blast unit 121 and injecting the received outside air.

Such a first air knife unit 122 includes a first base unit 122*a*, which the air received from the first air blast unit 121 flows into, is formed; and a first cover unit 122*b* that is installed on one surface of the first base unit 122*a* so that an injection space is formed along the longitudinal direction of the first base unit 122*a*. At one end of the such first base unit 122*a* and first cover unit 122*b*, a taper may be formed, facing the injection space side, so that the air being injected in the injection space inhales the surrounding air, thereby improving the injection force of the air.

By the first air barrier being generated by the first air knife unit 122 described above, inflow of fog from a side direction of the road is effectively blocked. In addition, such a first air barrier eliminates the need to install a conventional fog barrier having a large self-weight and a large area. Therefore, the wind load and total weight of the system can be significantly reduced, leading to an effect of a possibility to install the system on a bridge.

The first rotation unit 123 rotates one end of the first air knife unit 122 to adjust the direction of the air being injected from the first air knife unit 122 described above, and the first rotation unit 123 may be installed on the first base unit 122*a*.

Such a first rotation unit 123 may be provided as a stepping motor or a Servo motor to enable numerical control.

Operations of such a first rotation unit 123 are controlled by the control unit 140 that will be described hereinbelow. The control unit 140 controls the first rotation unit 123 based on the wind speed information being generated in the second detection unit 150. According to the first rotation unit 123 being controlled by the control unit 140 as described above, an angle of generation of the first air barrier may be adjusted in response to the direction of wind on the road, and therefore, efficiency of blocking inflow of fog can be significantly improved.

The first heat unit 124 heats the air being supplied from the first air blast unit 121 to the first air knife unit 122 so that the air being injected from the first air knife unit is injected at a preset temperature, and the first heat unit 124 is connected to the first air blast unit 121.

According to such a first heat unit 124, the fog surrounding the first air barrier can be dissipated by heat, and therefore, efficiency of blocking inflow of fog can be significantly improved.

Meanwhile, such a first heat unit 124 may be installed inside the first air blast unit 121, and due to the first heat unit 124 being installed inside the first air blast unit 121, there is an effect of significantly reducing the space where the configurative elements are installed, and also an effect of improving the aesthetic aspect as well.

Therefore, according to the first injection unit 120 that includes the first air blast unit 121, the first air knife unit 122, the first rotation unit 123 and the first heat unit 124 described above, the first air barrier may be easily formed at one side of the road, and therefore, effectively blocking inflow of fog at one side of the road.

The first detection unit 130 is installed on the first frame unit 110 described above to detect the fog, and when it is detected that the fog is of a preset value or above, the first detection unit 130 generates the fog signal and transmits the generated fog signal to the control unit 140.

Such a first detection unit 130 may be provided in a manner using a laser, or may be driven in a form of self-generation using a solar cell.

The control unit 140 is controlled by operations of the first air blast unit 121 and the first rotation unit 123 described above, and the second air blast unit 161 and the second rotation unit 163, that will be described hereinbelow, and the control unit 140 is electrically connected with the first air blast unit 121, the first rotation unit 123, the second air blast unit 161, the second rotation unit 163, the first detection unit 130, and the second detection unit 150.

The control unit 140 receives the fog signal being generated from the first detection unit 130 and controls operations of the first air blast unit 121 and the second air blast unit 161, and the control unit 140 receives the wind speed signal being generated from the second detection unit 150 and controls operations of the first rotation unit 123 and the second rotation unit 163.

By such a control unit 140, the first air barrier is formed only when the fog is generated near the road, and therefore, efficiency of the system can be significantly improved, and the angle of generation of the air barrier can be adjusted in response to the direction of wind on the road, the therefore, efficiency of blocking inflow of fog can be significantly improved.

Meanwhile, such a control unit 140 may be provided to adjust operations of the first air blast unit 121, the first rotation unit 123, the second air blast unit 161 and the second rotation unit 163, using the weather information and road information being transmitted from outside organizations such as meteorological agencies and public road corporations.

The second detection unit 150 is installed on the first frame unit 110, and detects the wind speed and transmits the generated wind speed information to the control unit 140 described above. Here, the wind speed information includes information about the wind intensity and wind direction in the area surrounding the road.

The second injection unit 160 connects an upper end of the plurality of first frame units 110, and the second injection unit 160 forms a second air barrier by injecting the air in a width direction of the road. Such a second injection unit 160 includes the second air blast unit 161, the second air knife unit 162, the second rotation unit 163 and a second heat unit 164.

The second air blast unit 161 inhales the outside wind and supplies the inhaled wind to the second air knife unit 162 that will be described hereinbelow, and the second air blast unit 161 is installed on the first frame unit 110 described above.

Operations of such a second air blast unit 161 are controlled by the control unit 140 described above. The control unit 140 controls operations and stop of the second air blast unit 161 based on the fog signal generated in the first detection unit 130. By the second air blast unit 161 that is controlled by such a control unit 140, the second air barrier is formed only when the fog is generated near the road, and therefore, efficiency of the system can be significantly improved.

Meanwhile, inside such a second air blast unit 161, a motor for absorbing and delivering the outside air, may be installed, and as this motor rotates, heat energy may be generated in the motor. By such heat energy, heat may be supplied to the gas being supplied to the second air knife unit 162, and by such heat included in the gas, the second air barrier may have heat. By such heat, the fog surrounding the second air barrier can be dissipated by heat, and therefore, efficiency of blocking inflow of fog can be significantly improved.

The second air knife unit 162 interconnects the upper end of the plurality of first frame units 110, that is, the upper end of the plurality of second pipes 112, arranged along the edge of the road, and the second air knife unit 162 forms the second air barrier by receiving the outside air from the second air blast unit 161 described above and injecting the received air in the direction of the edge of the road that it faces.

By such a second air barrier, there is an effect of effectively blocking inflow of fog existing on the upper side of the road.

Such a second air knife unit 162 includes a second base unit 162*a*, which the air received from the second air blast unit 161 flows into, is formed; and a second cover unit 162*b* that is installed on one surface of the second base unit 162*a* so that an injection space is formed along the longitudinal direction of the second base unit 162*a*. At one end of such second base unit 162*a* and second cover unit 162*b*, a taper may be formed, facing the injection space side, so that the air being injected in the injection space inhales the surrounding air, thereby improving the injection force of the air.

By the second air barrier being generated by the second air knife unit 162 described above, the fog existing at the upper side of the road is effectively blocked from flowing towards the road. In addition, such a second air barrier eliminates the need to install a conventional fog barrier having a large self-weight and a large area. Therefore, the wind load and total weight of the system can be significantly reduced, leading to an effect of a possibility to install the system on a bridge.

The second rotation unit 163 rotates one end of the second air knife unit 162 to adjust the direction of the air being injected from the second air knife unit 162 described above, and the second rotation unit 163 may be installed on the second base unit 162*a*.

Such a second rotation unit 163 may be provided as a stepping motor or a Servo motor to enable numerical control.

Operations of such a second rotation unit 163 are controlled by the control unit 140 that will be described hereinbelow. The control unit 140 controls the second rotation unit 163 based on the wind speed information being generated in the second detection unit 150. According to the second rotation unit 163 being controlled by the control unit 140 as described above, an angle of generation of the second air barrier may be adjusted in response to the direction of wind on the road, and therefore, efficiency of blocking inflow of fog can be significantly improved.

The second heat unit 164 heats the air being supplied from the air blast unit to the second air knife unit 162 so that the air being injected from the second air knife unit is injected at a preset temperature, and the second heat unit 164 is connected to the second air blast unit 161.

According to such a second heat unit 164, the fog surrounding the second air barrier can be dissipated by heat, and therefore, efficiency of blocking inflow of fog can be significantly improved.

Meanwhile, such a second heat unit 164 may be installed inside the second air blast unit 161, and due to the second heat unit 164 being installed inside the second air blast unit 161, there is an effect of significantly reducing the space where the configurative elements are installed, and also an effect of improving the aesthetic aspect as well.

Therefore, according to the second injection unit 160 that includes the second air blast unit 161, the second air knife unit 162, the second rotation unit 163 and the second heat unit 164, the second air barrier can be easily formed at an upper side of the road, and therefore, effectively blocking inflow of fog at the upper side of the road.

According to the air barrier system II for blocking inflow of fog according to a first embodiment of the present disclosure 100 that includes the first frame unit 110, the first injection unit 120, the first detection unit 130, the control unit 140, the second detection unit 150 and the second injection unit 160, provided is the air barrier system II for blocking inflow of fog, that does not affect wind load while effectively blocking inflow of fog to the road. Therefore, there is an effect of enabling installation of a fog removal system on a bridge. In addition, according to the present disclosure, there is an effect of installing the fog inflow blocking system while not undermining the scenery around the road.

The air barrier system II for blocking inflow of fog according to a second embodiment of the present disclosure will be described in detail hereinbelow with reference to the drawings attached.

FIG. 7 is an overall view of an air barrier system II for blocking inflow of fog according to a second embodiment of the present disclosure, and FIG. 8 is a plane view of the air barrier system II for blocking inflow of fog according to a second embodiment of the present disclosure.

As illustrated in FIGS. 7 and 8, the air barrier system II for blocking inflow of fog according to the second embodiment of the present disclosure 200 includes the first frame unit 110, the first injection unit 120, the first detection unit 130, the control unit 140, the second detection unit 150, a second frame unit 260, and a third injection unit 270.

Here, the first injection unit 120, the first detection unit 130, the control unit 140, and the second detection unit 150 are identical to the elements in the air barrier system II for blocking inflow of fog according to the first embodiment of the present disclosure 100, and therefore, repeated description will be omitted.

The second frame unit 260 is provided in plural and respectively connect the upper end of the one pair of first frame units 110 that face each other having the road between them, that is, the upper end of the one pair of second pipes 112, and the third injection unit 270 that will be described hereinbelow is installed along a longitudinal direction of the second frame unit 260.

The third injection unit 270 is installed along the longitudinal direction of the second frame unit 260 described above, and the third injection unit 270 forms a third air barrier by injecting air to the second frame unit 260 side that the third injection unit 270 faces.

Such a third injection unit 270 includes a third air blast unit 271, a third air knife unit 272, a third rotation unit 273, and a third heat unit 274.

The third air blast unit 271 inhales outside air and supplies the inhaled air to the third air knife unit 272, and the third air blast unit 271 is installed on the second frame unit 260 described above.

Operations of such a third air blast unit 271 are controlled by the control unit 140. The control unit 140 controls operations and stop of the third air blast unit 271 based on the fog signal generated in the first detection unit 130. By the third air blast unit 271 being controlled by such a control unit 140, the third air barrier is formed only when the fog is generated near the road, and therefore, efficiency of the system can be significantly improved.

Meanwhile, inside such a third air blast unit 171, a motor for absorbing and delivering the outside air, may be installed, and as this motor rotates, heat energy may be generated in the motor. By such heat energy, heat may be supplied to the gas being supplied to the third air knife unit 272, and by such heat included in the gas, the third air barrier may have heat. By such heat, the fog surrounding the third air barrier can be dissipated by heat, and therefore, efficiency of blocking inflow of fog may be significantly improved.

The third air knife unit 272 is installed along the longitudinal direction of the second frame unit 260 described above, and the third air knife unit 272 forms the third air barrier by receiving the outside air from the third air blast unit 271 described above and injecting the received outside air to the second frame unit 260 side that the third air knife unit 272 faces.

By such a third air barrier, there is an effect of effectively blocking inflow of fog existing at the upper side of the road.

Such a third air knife unit 272 includes a third base unit, which the air received from the third air blast unit 271 flows into, is formed; and a third cover unit that is installed on one surface of the third base unit so that an injection space is formed along the longitudinal direction of the third base unit. At one end of such third base unit and third cover unit, a taper may be formed, facing the injection space side, so that the air being injected in the injection space inhales the surrounding air, thereby improving the injection force of the air.

By the third air barrier being generated by the third air knife unit 272 described above, fog existing at the upper side of the road is effectively blocked from flowing to the road. In addition, such a third air barrier eliminates the need to install a conventional fog barrier having a large self-weight and a large area. Therefore, the wind load and total weight of the system can be significantly reduced, leading to an effect of a possibility to install the system on a bridge.

The third rotation unit 273 rotates one end of the third air knife unit 272 to adjust the direction of the air being injected from the third air knife unit 272 described above, and the third rotation unit 273 may be installed on the third base unit.

Such a third rotation unit 273 may be provided as a stepping motor or a Servo motor to enable numerical control.

Operations of such a third rotation unit 273 are controlled by the control unit 140 that will be described hereinbelow. The control unit 140 controls the third rotation unit 273 based on the wind information being generated in the third detection unit. According to the third rotation unit 273 being controlled by the control unit 140 as described above, the angle of generation of the third air barrier can be adjusted in response to the direction of wind on the road, and therefore, efficiency of blocking inflow of fog can be significantly improved.

The third heat unit 274 heats the air being supplied from the air blast unit to the third air knife unit 272 so that the air to be injected from the third air knife unit 272 is injected at a preset temperature, and the third heat unit 274 is connected to the third air blast unit 271.

According to such a third heat unit 274, the fog surrounding the third air barrier can be dissipated by heat, and therefore, efficiency of blocking inflow of fog can be significantly improved.

Meanwhile, such a third heat unit 274 may be installed inside the third air blast unit 271, and due to the third heat unit 274 being installed inside the third air blast unit 271, there is an effect of significantly reducing the space where the configurative elements are installed, and also an effect of improving the aesthetic aspect as well.

Therefore, according to the third injection unit 270 that includes the third air blast unit 271, the third air knife unit 272, the third rotation unit 273 and the third heat unit 274 described above, the third air barrier can be easily formed on an upper side of the road, and therefore, inflow of fog at the upper side of the road can be effectively prevented.

According to the air barrier system II for blocking inflow of fog according to the second embodiment of the present disclosure 200 that includes the first frame unit 110, the first injection unit 120, the first detection unit 130, the control unit 140, the second detection unit 150, the second frame unit 260 and the third injection unit 270, provided is an air barrier system II for blocking inflow of fog, that does not affect wind load while effectively blocking inflow of fog to the road. Therefore, there is an effect of a possibility to install a fog removal system on a bridge. In addition, according to the present disclosure, there is an effect of having a system for blocking inflow of fog installed without undermining the scenery around road.

The scope of rights of the present disclosure is not limited to the embodiments described above, and the present disclosure may be implemented as embodiments in various forms within the claims set attached hereto. Any person having ordinary skill in the art to which the invention pertains without departing from the gist of the invention as claimed in the claims is deemed to be within the scope of the claims of the invention to a wide range that can be modified.

What is claimed is:

1. An air barrier system II for blocking inflow of fog, comprising:

a first frame unit that is provided in plural and are installed along an edge of a road; and a first injection unit that is installed on the first frame unit and that injects air to the first frame unit side that the first injection unit faces, to form a first air barrier for blocking inflow of fog to the road, wherein the first injection unit comprises a first air blast unit that inhales outside air, and a first air knife unit that is installed along a longitudinal direction of the first frame unit and that receives the outside air from the first air blast unit and forms the first air barrier by injecting the received air, wherein the first air knife unit includes a first base unit in which the air received from the first air blast unit flows into and a first cover unit that is installed on a surface of the first base unit, wherein one end of the first base unit is tapered with a first angle and one end of the cover unit facing the one end of the first base unit is tapered with a second angle that is larger than the first angle.

2. The air barrier system II for blocking inflow of fog, according to claim 1, further comprising a first detection unit that is installed on the first frame unit to detect the fog, and that generates a fog signal in response to detecting a preset value of fog or above.

3. The air barrier system II for blocking inflow of fog, according to claim 2, further comprising a second detection unit that is installed on the first frame unit and that detects a wind speed to generate wind speed information, wherein the first injection unit further comprises a first rotation unit that rotates one end of the first air knife unit to adjust a direction of the air being injected from the first air knife unit.

4. The air barrier system II for blocking inflow of fog, according to claim 3, further comprising a third detection unit that is installed on the first frame unit, and that detects temperature to generate temperature information, wherein the first injection unit further comprises a first heat unit that heats the air being supplied from the air blast unit to the first air knife unit so that the air to be injected from the air knife unit is injected at a preset temperature.

5. The air barrier system II for blocking inflow of fog, according to claim 4, further comprising a second injection unit that is respectively connected to an upper end of the plurality of first frame units, and that forms a second air barrier by injecting air to a width direction of the road.

6. The air barrier system II for blocking inflow of fog, according to claim 5, wherein the second injection unit comprises a second air blast unit that is installed on the first frame unit and that inhales outside air, and a second air knife unit that forms the second air barrier by receiving the outside air from the second air blast unit and injecting the received air.

7. The air barrier system II for blocking inflow of fog, according to claim 6, wherein the second injection unit further comprises a second rotation unit that rotates one end of the second air knife unit to adjust a direction of the air being injected from the second air knife unit.

8. The air barrier system II for blocking inflow of fog, according to claim 7, wherein the second injection unit further comprises a second heat unit that heats the air being supplied from the air blast unit to the second air knife unit so that the air to be injected from the second air knife unit is injected at a preset temperature.

9. The air barrier system II for blocking inflow of fog, according to claim 4, wherein the first frame unit is provided in one pair and arranged to face each other with the road placed between the one pair of first frame units, and further comprises a second frame unit that is provided in plural and are respectively connected to an upper end of the one pair of first frame units that face each other with the road placed between the one pair of first frame units; and a third injection unit that is installed along a longitudinal direction of the second frame unit, and that forms a third air barrier by injecting air to the second frame unit side that the third injection unit faces.

10. An air barrier system II for blocking inflow of fog, comprising:

a plurality of first frame units and a plurality of second frame units arranged to face each other with a road in between, each of the first frame unit and the second frame unit having a first pipe installing on a ground of an edge of the road and a second pipe extending from the first pipe and slanting towards the road;

a plurality of first air knife units are installed on the plurality of first frame units and the plurality of second frame units, respectively, each of the plurality first air knife units is disposed facing each other along a length of the first pipe of the first frame unit and the second pipe of the second frame unit so that air injected from the each of the plurality first air knife units is directed to adjacent the first air knife units, thereby forming an air barrier between the first frame units;

a second air knife unit that is installed on the second pipe of the first frame unit to connect adjacent the first frame units to each other; and a third air knife unit that is installed on the second pipe of the second frame unit to connect adjacent the second frame units to each other, wherein each of the second air knife unit and the third air knife unit is disposed facing each other so that the air injected from the each of the second air knife unit and the third air knife unit is directed to each other, thereby forming the air barrier between the second air knife unit and the third air knife unit.

* * * * *